US010562317B2

(12) United States Patent
Peeters

(10) Patent No.: US 10,562,317 B2
(45) Date of Patent: Feb. 18, 2020

(54) METHOD OF PRINTING

(71) Applicant: OCÉ HOLDING B.V., Venlo (NL)

(72) Inventor: Guus M. C. Peeters, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/152,616

(22) Filed: Oct. 5, 2018

(65) Prior Publication Data

US 2019/0030911 A1 Jan. 31, 2019

Related U.S. Application Data

(63) Continuation of application No. PCT/EP2017/058618, filed on Apr. 11, 2017.

(30) Foreign Application Priority Data

Apr. 14, 2016 (EP) ..... 16165440

(51) Int. Cl.
*B41J 2/175* (2006.01)

(52) U.S. Cl.
CPC ..... *B41J 2/17596* (2013.01); *B41J 2/175* (2013.01); *B41J 2/17523* (2013.01)

(58) Field of Classification Search
CPC .... B41J 2/175; B41J 2/17523; B41J 2/17596; B41J 2/18; B41J 2/185
See application file for complete search history.

(56) References Cited

U.S. PATENT DOCUMENTS

2010/0079562 A1 4/2010 Katada
2010/0110155 A1 5/2010 Delueg
2011/0234711 A1* 9/2011 Gengrinovich ..... B41J 2/175 347/85
2012/0026256 A1 2/2012 Shibata
2014/0118429 A1* 5/2014 Gengrinovich ..... B41J 2/175 347/6
2015/0049145 A1 2/2015 Walker et al.

FOREIGN PATENT DOCUMENTS

| | | |
|---|---|---|
| EP | 1 946 849 A1 | 7/2008 |
| EP | 2 127 885 A1 | 12/2009 |
| EP | 2 402 162 A1 | 1/2012 |
| EP | 2 826 628 A1 | 1/2015 |
| WO | WO 2009/049130 A1 | 4/2009 |
| WO | WO 2009/049150 A1 | 4/2009 |

OTHER PUBLICATIONS

European Search Report issued in European Application No. 16165440.5, dated Oct. 4, 2016.
International Search Report for PCT/EP2017/058618 (PCT/ISA/210) dated Jun. 30, 2017.
Written Opinion of the International Searching Authority for PCT/EP2017/058618 (PCT/ISA/237) dated Jun. 30, 2017.

* cited by examiner

*Primary Examiner* — Anh T Vo
(74) *Attorney, Agent, or Firm* — Birch, Stewart, Kolasch & Birch

(57) ABSTRACT

An ink jet printer includes a number of print heads, each of which has a first port and a second port; an ink supply; a drain line; a first manifold connecting the ink supply to the first port of each print head; and a second manifold connected to the second port of each print head and connectable to the drain line. A valve system is arranged to disconnect the second manifold from the drain line and to connect the second manifold to the ink supply.

9 Claims, 1 Drawing Sheet

METHOD OF PRINTING

CROSS-REFERENCE TO RELATED APPLICATIONS

This application is a Continuation of PCT International Application No. PCT/EP2017/058618, filed on Apr. 11, 2017, which claims priority under 35 U.S.C. § 119 to Application No. 16165440.5, filed in Europe on Apr. 14, 2016. The entirety of each of the above-identified applications is expressly incorporated herein by reference.

BACKGROUND OF THE INVENTION

1. Field of the Invention

The present invention relates to an ink jet printer comprising a number of print heads, each of which has a first port and a second port; an ink supply; a drain line; a first manifold connecting the ink supply to the first port of each print head; and a second manifold connected to the second port of each print head and connectable to the drain line.

2. Background of the Invention

An ink jet printer of this type has been described in U.S. Application Publication No. 2015/0049145 A1.

When the printer is operating, ink is supplied from the ink supply channel to the first port of each print head via the first manifold. As is well known in the background art, each print head has one or more, typically a large number, of pressure chambers to which the ink is supplied via the first port at an inlet side of the print head. Each pressure chamber is connected to a nozzle, and actuators, e.g. piezoelectric actuators, are arranged in or adjacent to the pressure chambers and can be energized so as to create an acoustic pressure wave in the ink in the pressure chamber, causing a droplet of ink to be expelled from the nozzle.

The second manifold is a maintenance manifold, which may be used to drain the ink from the pressure chambers of all print heads and from the entire ink supply system. Preferably, the second port of each print head is arranged on an outlet side of the print head, opposite to the inlet side. In a maintenance operation, the maintenance manifold may be used for scavenging the flow path from the ink supply channel to the pressure chambers of each print head with ink or with a cleaning liquid, which is supplied in place of the ink. This permits, for example, to remove air bubbles or solid impurities from the ink flow path. The drain line may, for example, be connected to a suction pressure source or may just drain the liquid under the action of gravity.

SUMMARY OF THE INVENTION

It is an object of the present invention to provide an ink jet printer of this type which can maintain a high print quality more reliably.

In order to achieve this object, the ink jet printer according to the present invention includes a valve system arranged to disconnect the second manifold from the drain line and to connect the second manifold to the ink supply channel.

When the printer is operating and the second manifold is not needed for maintenance purposes, it is thus possible to use the second manifold as an additional supply path for supplying liquid ink to each print head. This has the advantage that the flow resistance opposing the flow of ink into the pressure chambers of each print head is reduced and an ink pressure drop caused by this flow resistance is reduced accordingly. Thus, the pressure at which the ink is supplied to the print heads can be held more reliably at a value sufficiently high for preventing malfunction or failure of a nozzle. Moreover, when a sudden increase in the demand of ink occurs because a large number of nozzles are fired simultaneously, the second manifold may serve as an ink buffer for absorbing the momentous increase in the demand for ink.

More specific optional details of the invention are indicated in the dependent claims.

The valve system may be operated manually or electronically and may comprise a valve that connects the second manifold either directly to the ink supply channel or to the first manifold.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
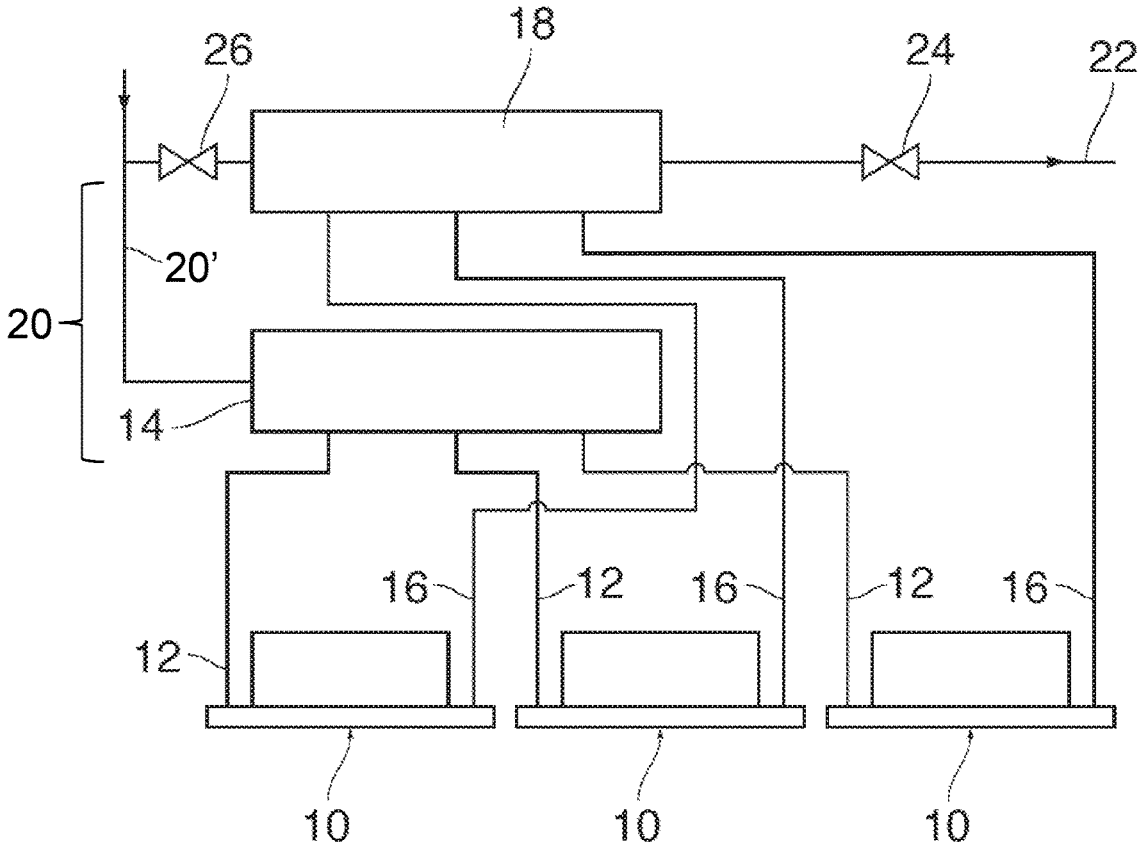
FIG. 1 is a block diagram of a printer according to a first embodiment of the invention.

The present invention will now be described with reference to the accompanying drawings, wherein the same or similar elements are identified with the same reference numeral.

As is shown in FIG. 1, an ink jet printer has a number (at least one, three in this example) of print heads 10. Each print head has a first port 12 connected to a first manifold 14 and a second port 16 connected to a second manifold 18. The first manifold 14 is connected to an ink supply channel 20'. The second manifold 18 is connectable to a drain line 22 via an open/close-type drain valve 24. A supply valve 26 permits connection of the second manifold 18 to the ink supply 20. The ink supply 20 comprises ink supply channel 20' and optionally the first manifold 14.

During a print operation, the drain valve 24 is closed and the supply valve 26 is open, so that liquid ink is supplied to each of the print heads 10 via two paths. The first path is formed by the ink supply channel 20', the first manifold 14 and the first ports 12, and the second path is formed by the ink supply channel 20', the second manifold 18 and the second ports 16. The ink will thus enter each print head from two opposite sides.

When the printer is not operating and a maintenance operation is to be performed, the print heads 10 may be flushed with liquid ink or with a special cleaning liquid after the ink distribution system has been emptied. To that end, the supply valve 26 is closed and the drain valve 24 is opened, so that the ink or cleaning liquid (or air in case of an emptying operation) flows into the print heads 10 only via the first manifold 14 and the first ports 12 and the ink or cleaning liquid leaves the print heads via the second ports 16, the second manifold 18 and the drain line 22.

When the printer is operating, the demand for ink of the print heads 10 may be subject to substantial fluctuations, depending upon the nature of the image to be printed. Since the conduits of the ink supply system supplying the ink from the ink supply channel 20' to each of the print heads 10 have a certain flow resistance, a sudden increase in the consumption of ink in an individual print head 10 or in all print heads will cause a certain pressure drop in the ink supply system. When this pressure drop becomes too large, the result may be nozzle failures or nozzle malfunctions and, consequently, a poor quality of the printed image. However, in the printer that is being described here, the second ports 16 and the second manifold 18, which had been provided only for maintenance purposes in known printers, can also be used for supplying ink to the print heads, so that the available cross section of the ink supply circuitry is approximately twice as high as in the background art and the flow resistance and the pressure drop will be significantly smaller, which permits a more stable operation of the printer with high print quality. Moreover, the volume of the second manifold 18 may serve as an additional buffer which helps in dampening the fluctuations in the demand for ink.

Figure 2:
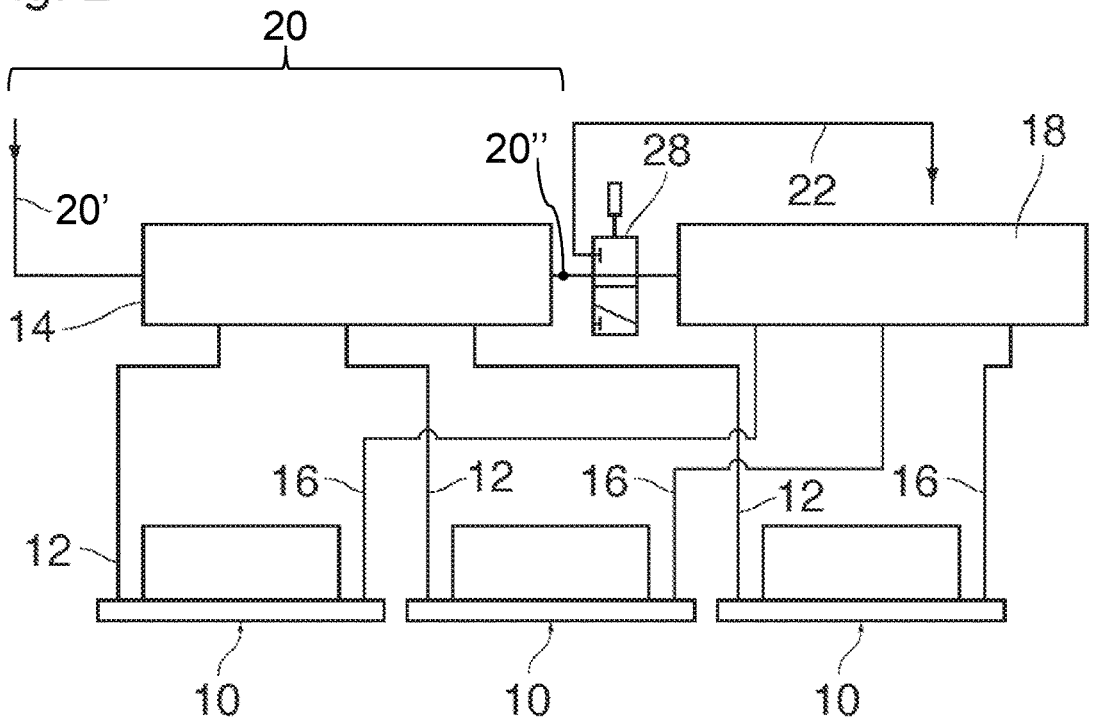
FIG. 2 is a block diagram of a printer according to a second embodiment.

FIG. 2 shows a modified embodiment in which the ink supply 20 comprises ink supply channel 20', the first manifold 14, and a fluid connection line 20". In this embodiment, the second manifold 18 is connected to the ink supply 20 and to the drain line 22 via an electric or pneumatic two-way valve 28. When the printer is operating, the valve 28 is in the position shown in FIG. 2, wherein the second manifold 18 is connected to the ink supply 20 and the drain line 22 is blocked, so that ink supplied from the ink supply channel 20' can flow to the print heads 10 along two paths, a first path being constituted by the first manifold 14 and the first ports 12, and a second path being constituted by the first and second manifolds 14, 18 and the second ports 16.

When the ink distribution system is to be emptied and/or a maintenance operation is to be performed, the valve 28 is switched to a position in which it connects the second manifold 18 to the drain line 22 and blocks the connection to the first manifold 14.

In a first mode of operation, the printer is in a print operation where liquid ink is supplied to each of the print heads 10 via both the ink supply 20 and the second manifold 18, wherein the ink supply 20 comprises ink supply channel 20' and the first manifold 14.

In a second mode of operation, the printer is in a maintenance operation where liquid ink is supplied to each of the print heads 10 via only the ink supply 20 and the liquid ink is drained from the print heads 10 via the second manifold 18, wherein the ink supply 20 comprises ink supply channel 20' and the first manifold 14.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet printer comprising:

a number of print heads, each of the number of print heads having a first port and a second port;

an ink supply;

a drain line;

a first manifold connecting the ink supply to the first port of each of the number of print heads;

a second manifold connected to the second port of each of the number of print heads, the second manifold being connectable to the drain line; and a valve system arranged to disconnect the second manifold from the drain line and to connect the second manifold to the ink supply.

2. The printer according to claim 1, wherein the valve system comprises an open/close-type valve connecting the second manifold to the drain line and an open/close-type supply valve connecting the second manifold to the ink supply.

3. The printer according to claim 1, wherein the valve system comprises a two-way valve, the two-way valve, in a first position, connecting the second manifold to the ink supply and blocking the drain line and, in a second position, connecting the second manifold to the drain line and blocking the connection to the ink supply.

4. The printer according to claim 1, wherein the valve system is arranged to connect the second manifold to the ink supply indirectly via the first manifold and a fluid connection line.

5. The printer according to claim 1, wherein the ink supply includes an ink supply channel and the first manifold.

6. The printer according to claim 5, wherein, for each of the number of print heads, a first ink supply path is formed by the ink supply channel, the first manifold and the first ports, and a second ink supply path is formed by the ink supply channel, the second manifold and the second ports.

7. The printer according to claim 1, wherein the drain line is configured in such a manner that when the valve system enables the second manifold to connect to the drain line while the printer is not operating, the ink to be drained, or a liquid that is used to flush the print heads or an air flow flows into the print heads only via the first manifold and the first ports, and leaves the print heads via the second ports, the second manifold and the drain line.

8. A method of operating an ink jet printer, comprising the steps of:

supplying ink to a number of the print heads via an ink supply and a second manifold when the printer, in a first mode of operation, is in a print operation; and supplying ink to the print heads via the ink supply and at the same time draining ink from the print heads via the second manifold when the printer, in a second mode of operation, is in a maintenance operation.

9. The method of operating an inkjet printer according to claim 8, wherein each of the number of print heads have a first port and a second port, and the ink supply includes an ink supply channel and a first manifold, and wherein, for each of the number of print heads, a first ink supply path is formed by the ink supply channel, the first manifold and the first ports, and a second ink supply path is formed by the ink supply channel, the second manifold and the second ports.

* * * * *